US005717424A

United States Patent [19]

Simson et al.

[11] Patent Number: 5,717,424

[45] Date of Patent: Feb. 10, 1998

[54] BANNER DISPLAY DEVICE

[76] Inventors: Anton K. Simson, 13227 Aubrey St.; Peter C. Brusso, 14530 Espola Rd., Suite A, both of Poway, Calif. 92064

[21] Appl. No.: 605,974

[22] Filed: Feb. 23, 1996

Related U.S. Application Data

[63] Continuation-in-part of Ser. No. 195,394, Feb. 14, 1994, Pat. No. 5,493,802, which is a continuation-in-part of Ser. No. 67,738, May 26, 1993, Pat. No. 5,410,330.

[51] Int. Cl.[6] ..... G09G 3/00

[52] U.S. Cl. ..... 345/110

[58] Field of Search ..... 345/57, 110; 318/6, 318/7; 352/174, 180; 353/109; 40/471

[56] References Cited

U.S. PATENT DOCUMENTS

| | | | |
|---|---|---|---|
| 3,510,973 | 5/1970 | Mazzocco, Sr. | 40/31 |
| 3,726,031 | 4/1973 | Singer | 40/31 |
| 4,012,674 | 3/1977 | Spitsbergen et al. | 318/6 |
| 4,448,368 | 5/1984 | Skalko | 318/7 |
| 4,720,661 | 1/1988 | Kisakibaru et al. . | |
| 4,862,614 | 9/1989 | Shettleroe | 40/593 |
| 4,942,411 | 7/1990 | Polston . | |
| 5,174,055 | 12/1992 | Aiken | 40/471 |
| 5,410,330 | 4/1995 | Simson et al. . | |
| 5,440,214 | 8/1995 | Peeters | 318/685 |
| 5,493,802 | 2/1996 | Simson . | |

*Primary Examiner*—Jeffery Brier

*Attorney, Agent, or Firm*—Henri J. A. Charmasson; John D. Buchaca

[57] ABSTRACT

A banner display device where a plurality of banners are mounted end-to-end to form a scroll which is wound on a pair of parallel and spaced-apart rollers, each driven by a motor. Pulse code modulated drive voltages are produced by microprocessor based command and control circuitry to accurately and efficiently turn the motors at speeds which impart proper tensioning of the scroll during winding.

9 Claims, 9 Drawing Sheets

BANNER DISPLAY DEVICE

PRIOR APPLICATION

This is a continuation-in-part application of application Ser. No. 08/195,394 filed Feb. 14, 1994 now U.S. Pat. No. 5,493,802 which was a continuation-in-part application of application Ser. No. 08/067,738 filed May 26, 1993 now U.S. Pat. No. 5,410,330.

FIELD OF THE INVENTION

This invention relates to scrolling banner display devices, and more particularly, to roller command and control, devices allowing replaceable banners and devices allowing flexibility of banner dimensions.

BACKGROUND OF THE INVENTION

Scrolling charts that are alternately wound back and forth between a pair of rollers are commonly used on chart recorders, advertising displays and other devices where information must be continuously or intermittently displayed. Typically, in the advertising display field for example, the scrolling chart comprises a plurality of banners. Each banner is a distinct image which is displayed by the device for a time until the next banner is to be displayed.

Previous display devices suffer from three distinct problems:

1) They do not provide for simple, fast and inexpensive removal, replacement, or otherwise not showing one or more of the individual banners in a scrolling chart;
2) One device will not be configurable to custom sized, user produced banners without being prohibitively expensive; and
3) The command and control circuitry is expensive, awkward and of limited configurability with respect to individual banner display times and relative motor tensioning due to differently sized charts.

As for the first problem, in the past, charts have been formed by preprinting the banners end-to-end on a long continuous sheet. The problem with this approach is that no single banner can be easily removed, replaced or skipped when a particular advertiser wishes to cease displaying their banner.

Changing a single banner involved a labor intensive, time consuming process requiring removal of the rollers from the display device, cutting out the offending banner, splicing in the new banner, and reinstalling the rollers. Splicing fixtures were developed allowing replacement while the rollers remained installed; however, replacement was still time consuming. It required significant care and skill to ensure proper banner positioning, alignment and proper placement of any control markings which inform the scrolling device where a banner begins and ends.

One solution to the interchangeability problem involved attaching individual banners together end-to-end to form a long continuous sheet. Here, durability and proper alignment became the overriding problem. A high degree of skill and time were still required to make an adequate interchange. Displays using this approach tended to be expensive, more complicated and less reliable because the means for attaching the banners to each other had to be rugged and precise to maintain proper alignment.

Another solution involved using pockets or other containment envelopes permanently formed on a web style carrier into which banners are inserted. From a mechanical standpoint, pockets formed from multiple layers of material attached together are generally incapable of being rolled onto a roller without creating large wrinkles or lumps in the multiple layers which, in turn, causes alignment problems. This is due to the difference in circumference of the various layers as they are rolled onto a roller and the fact that the layers are attached to each other at the endpoints. Inserting a banner inside a pocket adds a third layer between the pocket layers which further compounds the problem by increasing the radial difference between the wound layers, further encouraging lumps and wrinkles.

Using resilient materials such as soft vinyl fabric to form the pockets do allow outer layers to stretch and inner layers to compress. However, as the material stretches longitudinally, its width tends to contract, like a rubber band. Similarly, as it is compressed, the width will expand. The net effect is that bulges and wrinkles are still formed.

In general, the use of larger diameter rollers will proportionally reduce the problem, but the problem still exists. Similarly, using dissimilar materials for the front and back layers of the pocket offer only moderate improvement. For example, one may use relatively stiff plastic for the inner layer and soft vinyl for the outer layer. The resilient outer vinyl will stretch as it is wound and contract during display. This may work well in the short term, however, after being repeatedly wound and displayed, the vinyl will relax, creating a loose front surface that encourages lumps and wrinkles.

Therefore, the use of pockets will cause wrinkles or lumps when rolled up and/or wrinkles, lumps or otherwise unacceptable optics when displayed flat.

Another solution disclosed by Mazzocco, Sr. in U.S. Pat. No. 3,510,973 involves attaching removable banners to permanent sliding attachment points mounted on a web style carrier allowing relative longitudinal displacement between banner and web (See Mazzocco Column 5, lines 3–26). One problem with this approach again involves wrinkling since the fastening strips or button-like tabs will not lie completely flat when wound onto a roller. Another problem is cost since the disclosed button-like tabs must be made rugged enough to allow the repeated sliding and banner interchanges. In addition, the banners themselves must be made rugged so that the slots for the tabs do not wear through. In this field, ruggedization is synonymous with expense. Further, this approach causes scraping between the banner and web. Any dust or dirt caught between the layers will quickly cause scratches to the banner surface reducing its aesthetic appeal.

Accordingly, there is a need for an inexpensive device for adequately displaying banners which may be simply and quickly interchanged, removed altogether or skipped.

As for the second problem, there is no industry standard size for banners. Often times, banner size varies according to many factors such as budget, the subject matter of the display, and its location in a particular venue. Previous devices such as disclosed by Singer (U.S. Pat. No. 3,726,031) provide a specific enclosure requiring specific banner sizes. Although both Shettleroe (U.S. Pat. No. 4,862,614) and Simson (U.S. Pat. No. 5,493,802) provide some flexibility in the vertical and horizontal dimensions respectively, it is somewhat limited. Displaying banners with dimensions falling outside the limited range of these devices incurs the cost of buying or building a new device of a different scale. Therefore, there is a need for a banner display apparatus having greater flexibility in banner size.

As stated above, the third problem involves the relatively expensive command and control circuitry provided in current scrolling display devices. Simson et al., U.S. Pat. No. 5,410,330 discloses circuitry designed specifically for controlling the variable motor speeds required during the display of a roller based scrolling chart display. However, this circuitry has limited configurability with respect to roller speeds and display times per banner. Also, in general, the cost of manufacturing a circuit board and soldering components generally increases with the number of components used. In addition, a circuit made up of numerous discretely manufactured electronic devices is usually less reliable than those circuits requiring less discrete devices. Also, increasing the amount of hardware increases power consumption, which in turn may increase the number and cost of discrete devices. Accordingly, there is a need for an inexpensive scroll display apparatus which uses a minimum of hardware while providing greater command and control flexibility.

SUMMARY OF THE INVENTION

The principal and secondary objects of this invention are to provide a banner display apparatus which:

- is capable of being configured to skip certain individual banners;
- allows individual banners to be removed or replaced without removing and re-installing the rollers or carrier;
- is capable of being configured to display custom sized banners mounted on charts and rollers of different lengths and widths;
- has reduced circuitry hardware and increased flexibility of command and control of the rollers; and
- does not suffer from the disadvantages described above.

These and other objects are achieved by a banner display apparatus wherein a plurality of banners are mounted end-to-end to form a scroll which is wound on a pair of parallel and spaced-apart rollers. Strips of resiliently flexible materials are interposed between the banners and attached to a carrier. The width of the strips and their resiliency is adjusted so that when a banner is displayed between the rollers, the strips framing that banner are only partially wound over the rollers leaving marginal sections contiguous to the banners free to assume, due to their resiliency, a planar tangential position in relation to the rollers and to propel the banner outwards from the carrier, thereby applying a stretching force to the banner sufficient to eliminate slack, wrinkles and small distortions generated through unwinding.

In an embodiment of the invention, the flexible strips are mounted between banner-holding sections of a web style carrier, and have marginal flaps extending into the banner-holding sections and in bonded contact with the leading and trailing edges of the banners.

The embodiment further comprises two independent lateral support members capable of being mounted within enclosures having widely different widths. Components such as motors, transmissions, roller mounting spindles, control sensors and circuitry are mounted directly on the support members.

Command and control of the motors is accomplished through a programmed microprocessor which monitors the status of user manipulable switches and the status of sensors which detect banner position, chart tension and user manipulable chart display indicators. According to the microprocessor's software/firmware programming, pulse code modulated drive voltages are produced to accurately turn the motors at the proper speeds.

DESCRIPTION OF THE PREFERRED EMBODIMENT OF THE INVENTION

Figure 1:
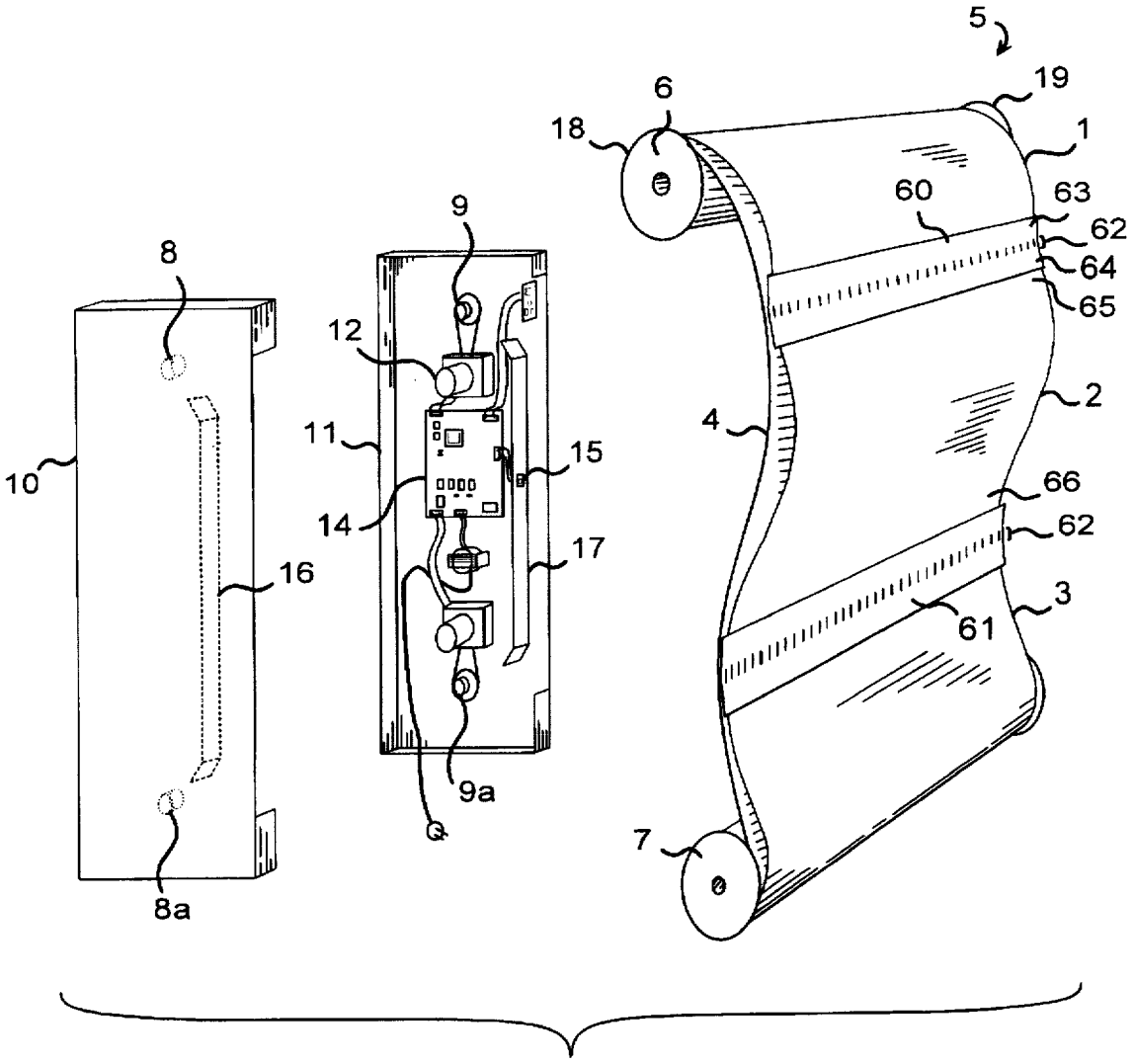
FIG. 1 is a perspective view of a banner display apparatus according to the invention.

Referring now to the drawing, there is shown in FIG. 1 a banner display apparatus where a plurality of pliable banners 1,2,3 are mounted upon the outer surface of a transparent web style carrier 4. The web/banner combination will be known collectively as a chart 5. The chart has opposite ends which are wound on a pair of substantially parallel and spaced-apart rollers 6,7.

Each roller can be rotatively mounted on a pair of spindles 8,9 each extending inwardly from one of a pair of opposing lateral support members 10,11. One of the pair of spindles is a drive spindle 9 which is mechanically coupled through a transmission to a motor 12, the other spindle 8 is spring loaded to allow for quick installation and removal of the rollers.

The lateral support members 10,11 provide support for critical components of the apparatus such as the spindles, motors, transmissions and control circuitry 14 including a chart position sensor 15, logic and power supplies. In addition, the lateral members provide edge guides 16,17 for maintaining the alignment of the traversing chart. Further alignment is provided by disk-shaped end plates 18,19 formed at the ends of both rollers. In addition, the rollers need not be absolutely parallel. By slightly increasing the distance between the spring loaded spindles, the scroll is encouraged toward the opposite side during winding.

The advantage of having independent support members is that a single pair of members can be mounted within enclosures having a wide range of dimensions which display custom sized banners mounted on charts and rollers of different lengths and widths. The support members are mounted to the enclosure using screws or other means known in the art.

Figure 2:
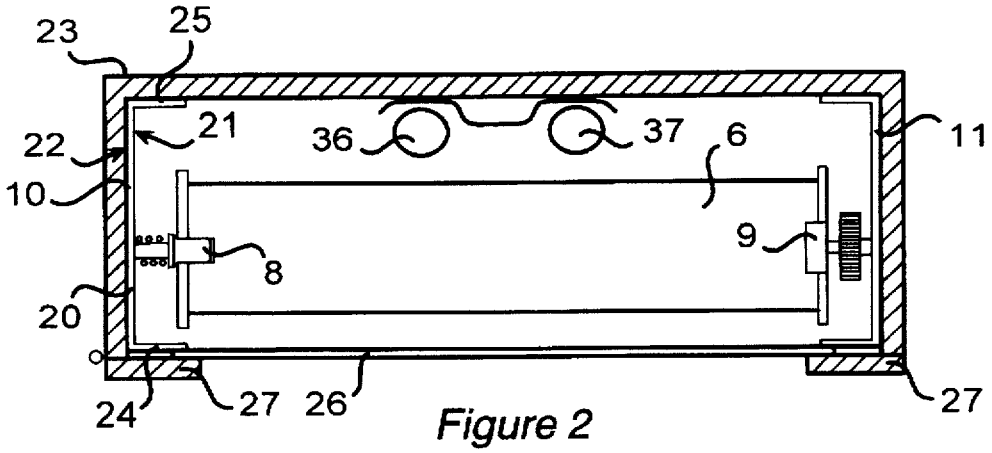
FIG. 2 is a cross-sectional diagrammatic top view of the apparatus of FIG. 1 as mounted within an enclosure.
Figure 3:
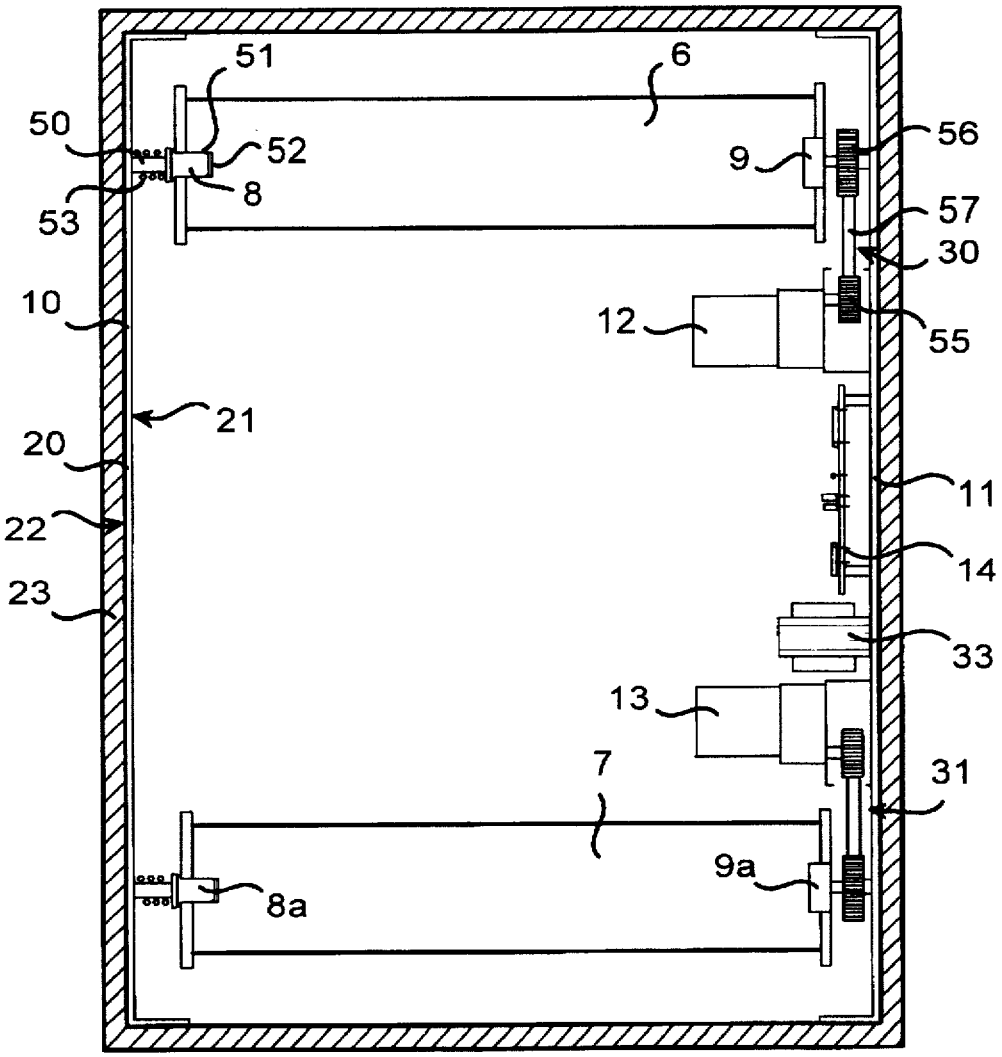
FIG. 3 is a cross-sectional diagrammatic front view of the apparatus of FIG. 1 as mounted within an enclosure.
Figure 4:
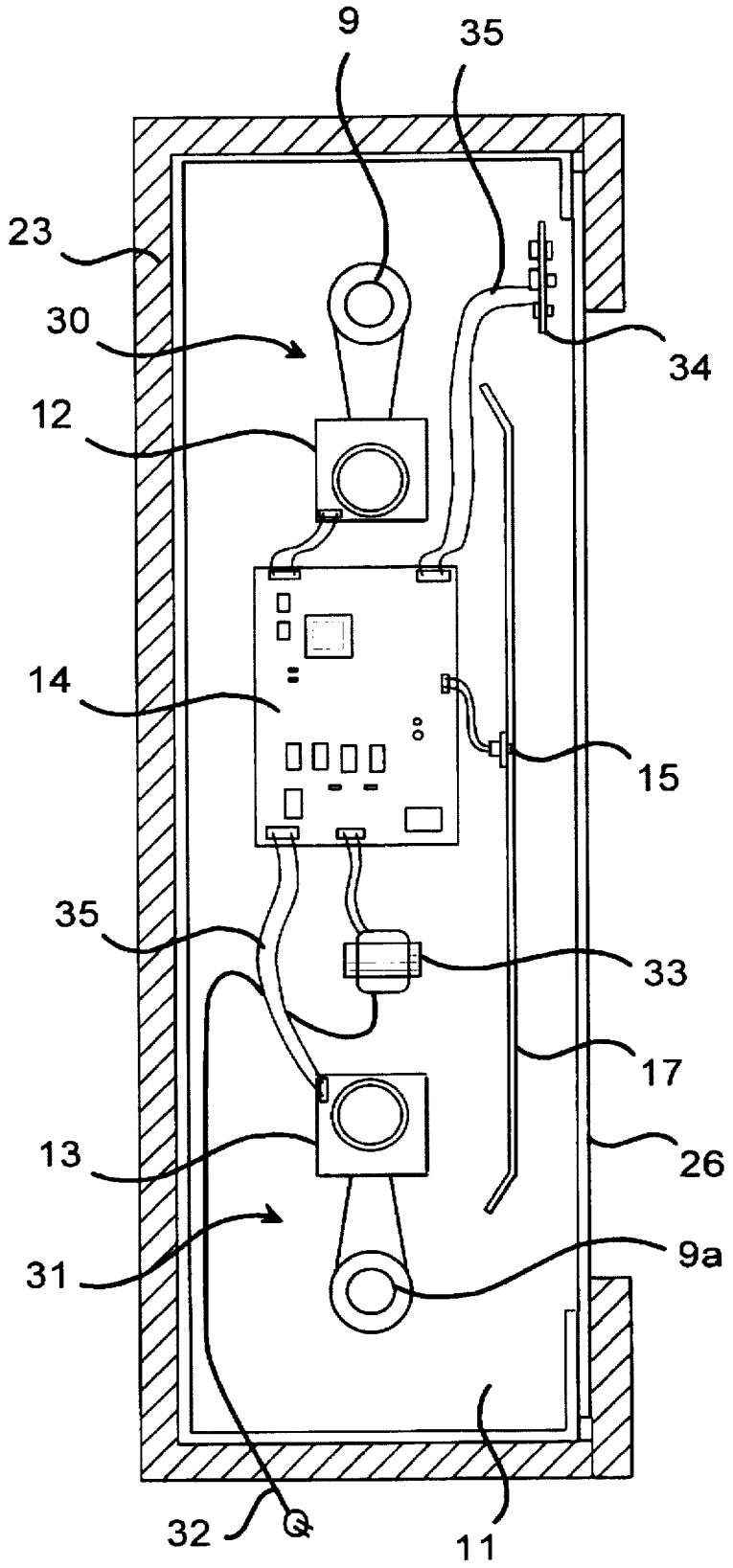
FIG. 4 is a cross-sectional side view of a support member of the apparatus of FIG. 1 upon which is mounted the major roller drive components.

Referring now to FIGS. 2, 3 and 4, the preferred mechanical features of the first and second lateral support members will now be described in detail. Each support member 10,11 comprises a base portion 20 having an inner surface 21 and a substantially planar outer surface 22 designed to rest flush against an inner wall of an enclosure 23. Front 24 and rear 25 flanges extend orthogonally from the base providing rigidity. In addition the rear flange provides a bearing surface for further securing the member to the enclosure. The front flange also provides a bearing surface for securing a transparent front viewing window 26 between the front flange and front door portions 27 of the enclosure.

Attached directly or indirectly to the base of each support member is a chart guide flange 17 to prevent the displayed portion of the chart from frolicking into the rear areas of the apparatus. Each chart guide extends in a generally orthogonal manner from a region of the base which is located proximate to an edge of the traversing chart. The guides restrict movement of the chart to generally a plane behind and parallel to the plane of the viewing window. The front viewing window 26 itself provides a bearing surface for the displayed portion of the banner and further protects the chart and other internal mechanisms of the apparatus.

The base of the one support member 11 forms a secure platform for the attachment of other components of the apparatus including top and bottom motors 12,13, their transmissions 30,31, drive spindles 9,9*a*, power cable 32, transformer 33, control circuitry printed circuit board 14, manual operator input control panel 34, and various interconnecting wiring 35. The other support member 10 forms a platform for the attachment of the spring loaded spindles 8,8*a*. In the preferred embodiment, most of the components are mounted on only one of the support members to reduce wiring and allow for greater flexibility in the separation between the members.

An optical chart position sensor 15 is mounted preferably on the support member carrying the other circuitry. The sensor is positioned on the chart guide 17 at a point between the two rollers, to detect the passage of indicia or marks placed along the corresponding edge of each chart frame containing a banner. The detailed operation of the sensor and indicia features will be described later.

Fluorescent tubes 36,37 are mounted in the center of the rear of the enclosure to provide backlighting of the scrolling chart.

Figure 5:
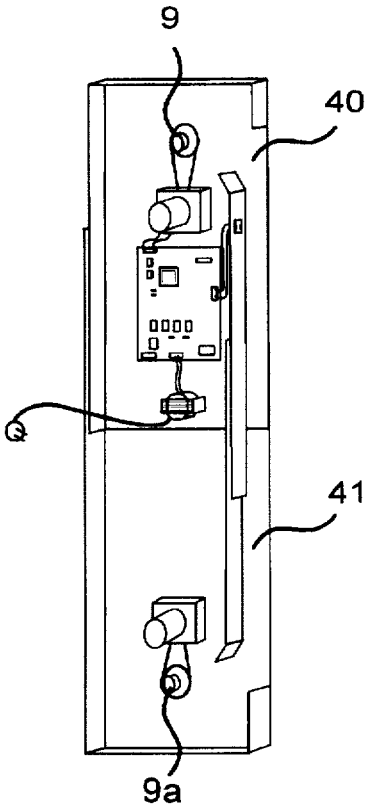
FIG. 5 is a perspective view of a support member according to a first alternate embodiment of the invention.

FIG. 5 shows that for added flexibility in spacing between the rollers, each lateral support member may comprise two interlocking sub-members. An upper sub-member 40 slidingly engages a lower sub-member 41. This arrangement allows the distance between the drive spindle 9 of the upper sub-member and the drive spindle 9*a* of the lower sub-member to be varied according to banner dimensions.

Figure 6:
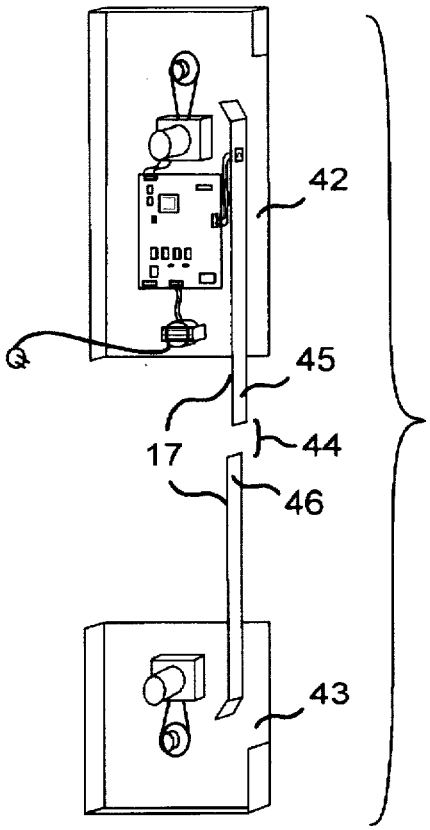
FIG. 6 is a perspective view of a support member according to a second alternate embodiment of the invention.

FIG. 6 shows that in a less convenient embodiment the sub-members 42,43 may be completely separated to allow maximum flexibility in banner dimensions. It should be noted that the sub-members may be spaced apart such that a gap 44 forms between ends 45,46 of the disconnected chart guide flange 17. Small gaps will not adversely affect display operation. However, if wider gaps are anticipated, a strip of rigid material should be attached or otherwise interposed between the guide ends, thereby reducing or eliminating the gap with respect to the guide flange.

The preferred roller bearing and rotational drive mechanisms will now be described. The lateral support members provide means for rotatably mounting the rollers. As stated above, a drive spindle 9 is provided on a first member 11 to engage one end of a roller 6, and a spring-loaded spindle 8 is provided on the opposite member 10 to engage the opposite end of the roller.

The drive spindle 9 simply provides means for transmitting torque to the roller 6. This can be accomplished through any means known to the art such as a keyed spindle described in Simson, U.S. Pat. No. 5,493,802 incorporated herein by reference, or other approaches which provide adequate friction between the drive spindle and roller.

As shown in FIG. 3, each spring loaded spindle 8 has a central axle 50 and a freely rotating end cap 51 dimensioned to engage a central hole 52 in the end of a roller 6. The end cap is biased toward the roller by a spring 53 concentrically mounted around the axle. The ends of the rollers may be made symmetrical so as to engage either type of spindle.

Torque is transmitted from the motors to the drive spindles via transmission means. Although it would be possible to have the motor drive shaft act as the rotational axle for the drive spindle, this would generally require the relatively bulky motor to exist lateral to an end of the roller. In the preferred approach, referring to FIG. 3, the a motor 12 directly drives a motor pulley 55, the rotation of which is transmitted to a roller drive pulley 56 through a belt 57. The roller drive pulley turns the axle of the drive spindle 9. In this way the bulk of the motor 12 can be located between the mounted rollers 6,7 and behind the exposed portion of the chart, thereby reducing the required width of the display apparatus. Further, the use of this type of belt and pulley assembly provides a damping mechanism between the motors and the rollers, reducing the transmission of noise and vibration. The belt and pulleys may be toothed to prevent slippage.

With reference to FIGS. 1, 7, 8 and 10 the preferred banner flattening mechanisms will now be described. FIG. 1 shows a plurality of banners 1,2,3, each made of pliable, laminar material, attached end-to-end to form a scroll. The scroll is carried upon a carrier web 4 of pliable, durable, substantially transparent material such as mylar. The scroll and web collectively form a chart 5 which is scrollable between two parallel, spaced apart rollers 6,7.

Interposed between each pair of adjacent banners is a resiliently flexible strip 60,61 of laminar material such as mylar. The strips are preferably black or otherwise opaque to maintain an aesthetic separation between banners and to prevent viewing of the internal mechanisms through the web as the scroll is being wound. Each strip 60,61 has a medial portion 62 which is attached to the web 4. Further, each strip has marginal flaps 63,64 extending into banner-holding sections of the web. Portions of the flaps are in bonded contact with the leading 65 and trailing 66 edges of the banners.

Although the carrier is preferably a solid transparent sheet, it may be ladder-shaped having central cutouts conforming with the banner display area.

Figure 8A:
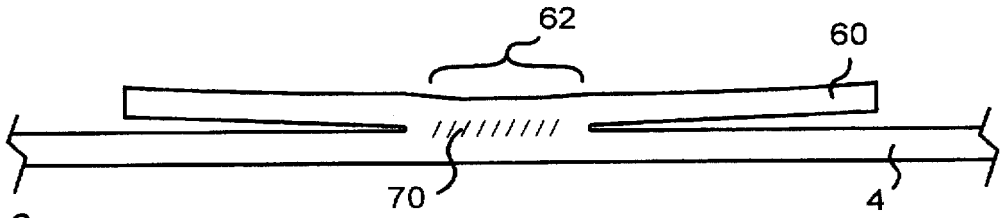
FIGS. 8, *a–f* shows six cross-sectional diagrammatic views of alternate embodiments of the banner-connecting, resiliently flexible strip feature of the invention.
Figure 8B:
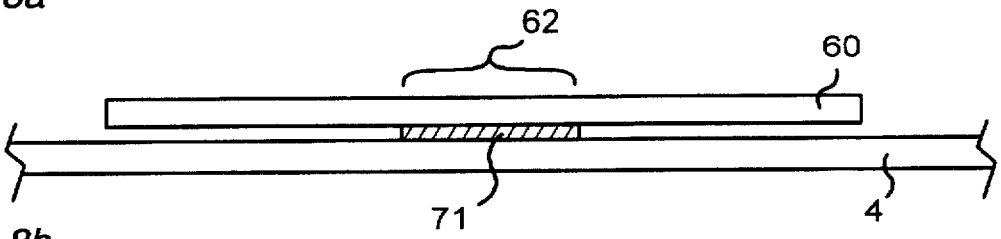
Figure 8C:
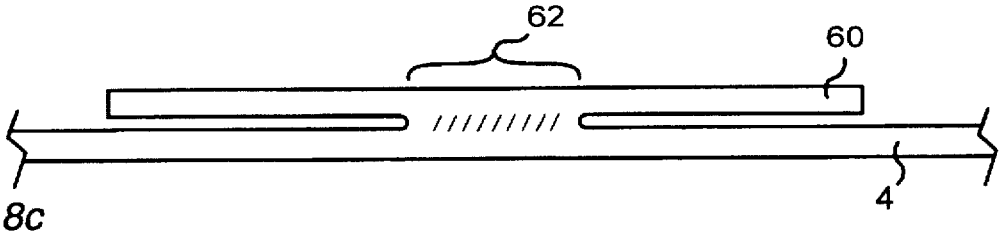
Figure 8D:
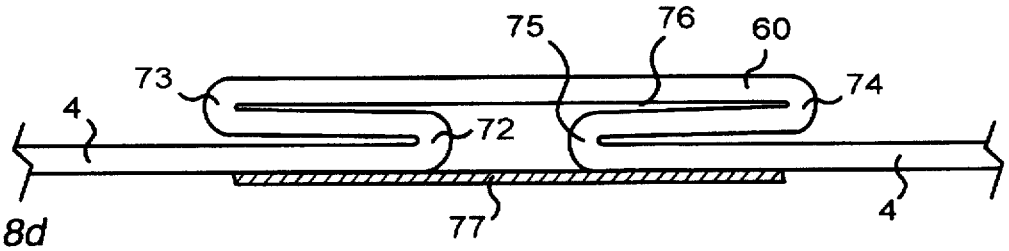
Figure 8E:
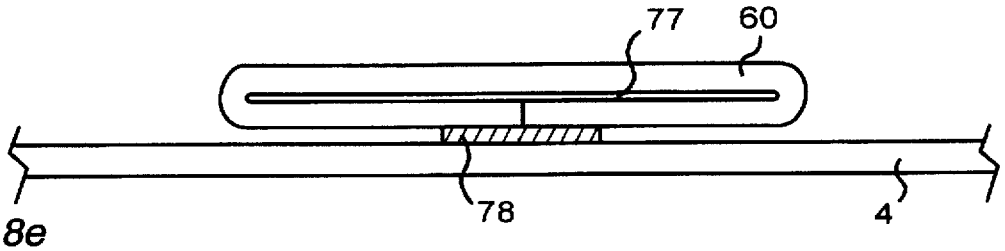
Figure 8F:
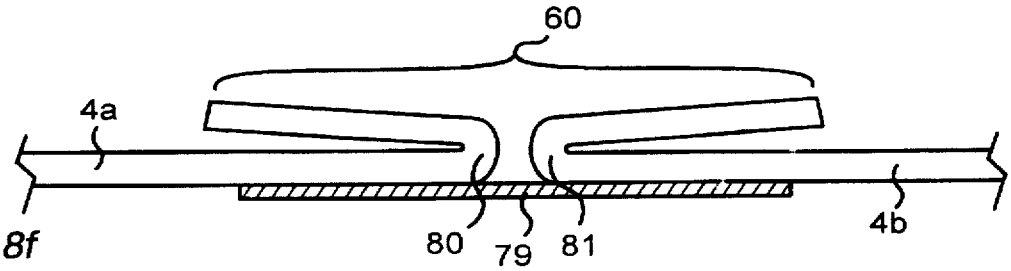

FIGS. 8*a*–8*f* show alternate ways of forming or attaching the flexible strips to the carrier web. In FIG. 8*a*, a medial portion 62 of the strip 60 has been heat welded 70 to the web 4. In FIG. 8*b*, a layer of adhesive 71 such as glue or double-sided adhesive tape attaches a medial portion 62 of a strip 60 to the web 4. In FIG. 8*c*, solvent was used to bond a medial portion 62 of the strip 60 to the web 4. In FIG. 8*d*, the transparent carrier web 4 is multiply folded 72,73,74,75 to form a pocket 76 into which a border message card may be inserted. A piece of single-sided adhesive tape 77 prevents the web from unfolding. Similarly, in FIG. 8*e*, a strip 60 is formed by a ring of transparent web material. Again, a pocket 77 is formed into which a message card may be inserted. The strip is attached to the web 4 by a layer of adhesive such as double-sided tape 78. Finally, FIG. 8*f* shows the carrier web formed by separate pieces 4*a*,4*b* bonded by a layer of single-sided adhesive tape 79. Each piece has an outward fold 80,81 which forms the resiliently flexible strip 60.

Figure 7:
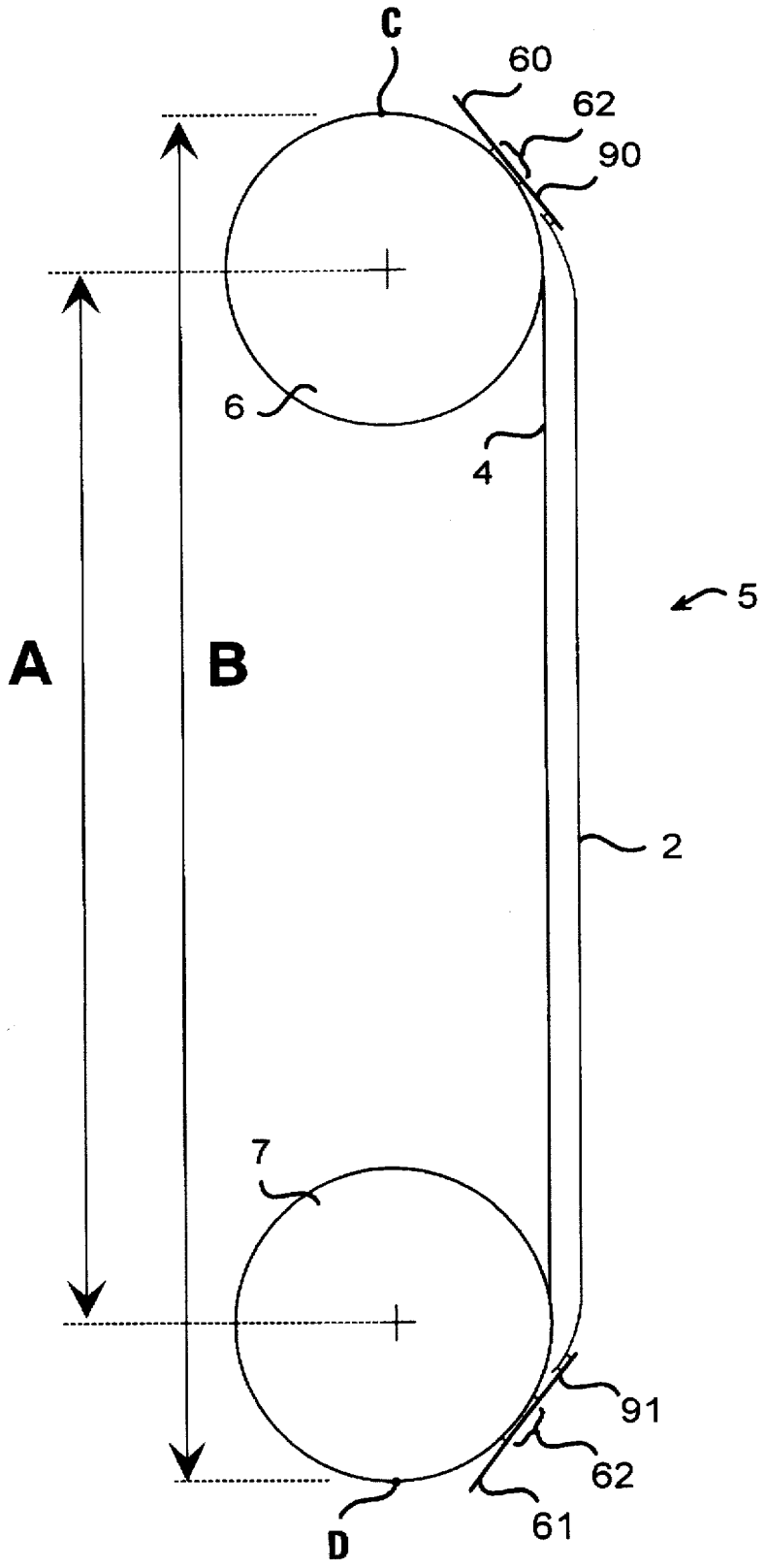
FIG. 7 is a cross-sectional diagrammatic side view of a chart wound upon two rollers showing the proper dimensions for implementing the banner flattening mechanism of the invention.

FIG. 7 shows a cross-sectional diagram of a scrolling chart 5 wound between a pair of substantially parallel, spaced apart rollers 6,7 according to the invention. A banner 2 is shown in its display position mounted between a pair of resiliently flexible strips 60,61 which are attached along a medial portion 62 to the carrier web 4. The width of the strips in the travel direction and their resiliency are adjusted so that when a banner is displayed between the rollers, each strip is only partially wound over the rollers leaving marginal sections 90,91 contiguous to the banners free to assume, due to their resiliency, a planar tangential position in relation to the rollers. The spring-like effect of the strips propel the banner 2 outwards from the carrier 4, thereby applying a stretching force to the banner sufficient to eliminate slack, wrinkles and small distortions generated through unwinding.

In order for the banner to be properly propelled outward from the carrier, the strips must be attached to the carrier within a range defined by the distance between the axes of rotation of the rollers "A", and the sum of "A" plus the maximum summed radius of each of the rollers with the scroll wound thereon, as signified by "B". The maximum summed radius occurs when the chart is evenly wound upon both rollers.

In other words, the distance between the attached median lines of any two adjacent strips, as measured along the carrier web, may fall within the range defined by the distance between the rollers "A", and the maximum length in the travel direction of the space occupied by the scroll. In FIG. 7, this latter maximum length would be the distance, along the web 4, from point "C", at the top of the top roller, to point "D", at the bottom of the bottom roller, when the chart is evenly wound between both rollers.

It has been found that for optimum banner flattening, the width of each strip will extend over an arc of approximately 20 to 45 degrees when the entire chart is wound onto one roller.

FIG. 10 illustrates some of the preferred means for releasably bonding banners to the resiliently flexible strips, each of which offers certain advantages and disadvantages. FIG. 10*a* shows a portion of the carrier web 4 onto which a flexible strip 60 has been attached. One end of a banner 2 is releasably attached to the strip by means of an adhesive layer 100 of material such as non-permanent glue, spirit gum or double-sided adhesive tape. Although the banner could be attached to an outer surface 101 of the strip, it is preferred that the banner attach to the inner surface 102 of the strip facing the carrier web 4 to protect the banner edge 103 and the adhesive layer. After repeated use the adhesive tends to lose its stickiness, requiring replacement. Therefore, individual banners may be provided with an adhesive layer already positioned at each end, protected by a removable wax paper cover, insuring fresh adhesive with each new banner.

Figure 10A:
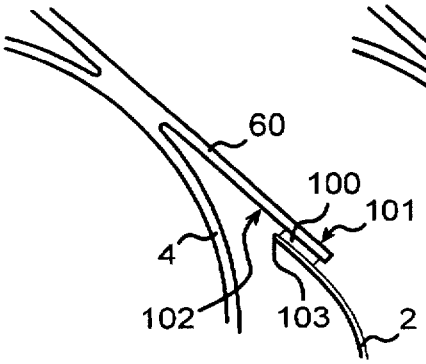
FIGS. 10, *a–f* shows six cross-sectional diagrammatic views of alternate embodiments of the means for bonding a banner to a resilient strip according to the invention.
Figure 10B:
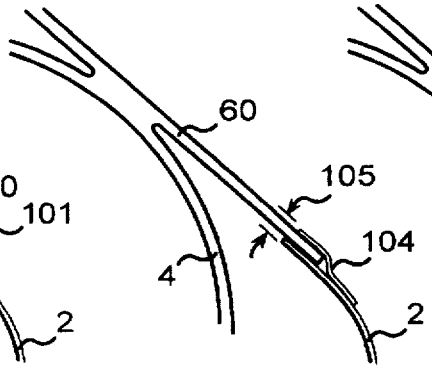
Figure 10C:
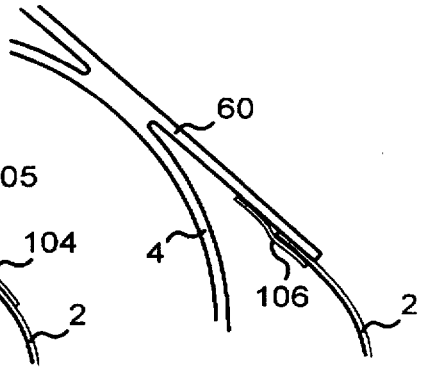

FIGS. 10*b* and 10*c* show that a piece of single-sided adhesive tape may be used to join an end of the banner 2 to the flexible strip 60. In 10*b* the adhesive tape 104 is placed on the outer surfaces of the banner and strip. The advantages of this scheme are that the banner/strip interface has a very thin cross-sectional thickness 105, and tape is inexpensive. However, the tape layer is visible during scroll winding. In 10*c* the tape 106 adheres to the inner surfaces of the banner and strip, and is therefore hidden from view. However, properly placing the tape during installation requires more skill. If stronger attachment is required, two pieces of tape may be used, one on the outer surface as shown in 10*b* and one on the inner surface as in 10*c*.

Figure 10D:
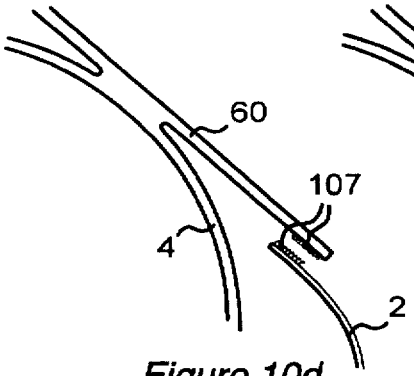

In FIG. 10*d*, hook-and-loop fabric style connectors such as Velcro Brand fasteners 107 are used to releasably connect an end of the banner 2 to an end of the flexible strip 60. However, the cross-sectional thickness of the connection is greater.

Figure 10E:
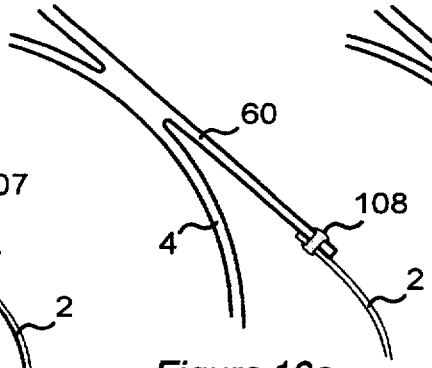

In FIG. 10*e* pop-through snap pins 108 may be used to join the banner 2 to the strip 60. The pins may be independent, or permanently attached to the strip or banner or both. This scheme offers very strong attachment, requires very little skill during banner installation and prevents lateral migration of the banner. However, the pins and/or holes through which the pins project must be precisely positioned, increasing manufacturing costs, and the cross-sectional thickness of this connection is relatively large.

Figure 10F:
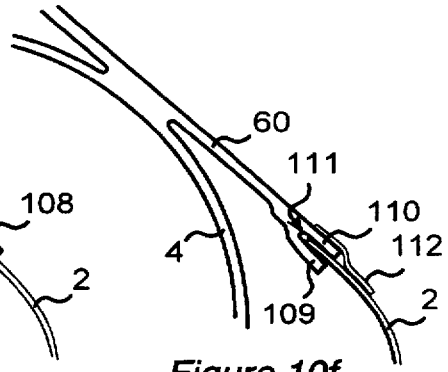

FIG. 10*f* shows two extensions 109,110 extending along the edge of the resiliently flexible strip 60 to form a slot 111 into which the edge of the banner 2 is inserted, providing more secure, immobile attachment. The extensions may be joined at their lateral edges so as to form a pocket to further discourage lateral migration of the banner. In this arrangement, any of the above described attachment schemes may be used. A piece of single-sided adhesive tape 112 is shown. This arrangement may be slightly more expensive to manufacture and exhibits a thicker cross-section.

Proper mounting of the banners is achieved automatically when installing or loading a banner into a particular frame. First, the top end of a banner is attached to a trailing flap of the upper resiliently flexible strip. With its bottom end free, the banner is then wound smoothly onto the top roller. Finally, the banner's bottom end is attached to the leading flap of the lower strip. It is apparent that this mounting method will work in either direction and for displays having vertical axis rollers.

The preferred method of running the motors is now described. In general, the motors are inexpensive D.C. motors of the type commonly found toys which turn in a direction and speed corresponding to the polarity and duty cycle of their drive voltages. However, depending on overall chart size, more or less powerful motors may be required.

As disclosed in Simson et al., U.S. Pat. No. 5,410,330, incorporated herein by reference, it is beneficial for the unwinding motor to provide a variable drag, as transmitted through the scroll, on the winding motor. This causes the scroll to remain taut and to traverse smoothly between the rollers. In addition, the unwinding motor provides energy efficient assistance in moving the chart. In the preferred embodiment of the invention, drag is accomplished by powering the unwinding motor using a pulse width modulated (PWM) drive voltage waveform in which the duty cycle duration is less than the duty cycle duration of the drive voltage waveform powering the pick-up motor.

A PWM drive voltage waveform may also be used to prevent sagging or drooping of the chart while a banner is being displayed. This can be a problem with heavier banners and fabric or paper banners which have become saturated with water. During non-winding times, one or both of the motors are given a PWM driving waveform having a winding polarity to stretch the chart taut. In this embodiment, of course, the winding polarity of one motor is opposite to the winding polarity of the other motor.

Figure 9:
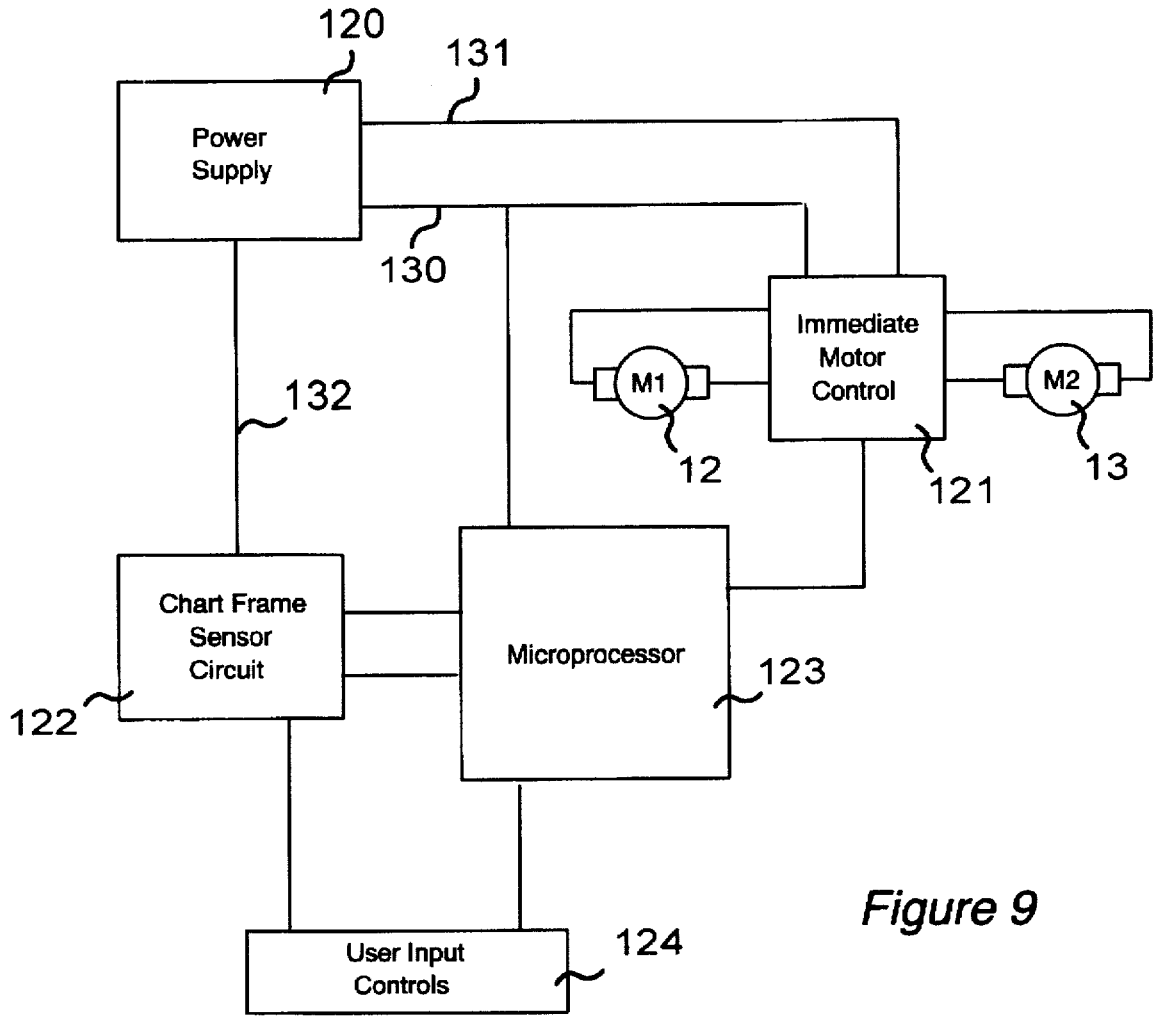
FIG. 9 is a block diagram of the preferred roller control circuitry of the invention.

With reference to FIGS. 9 and 10, the preferred roller command and control mechanisms and circuitry will now be described. Although circuitry described in Simson et al., U.S. Pat. No. 5,410,330 may be used, the preferred approach involves the use of a programmed microprocessor.

In general, FIG. 9 shows a functional block diagram of the major modules. The circuitry comprises a power supply circuit 120, motors 12,13, an immediate motor control circuit 121, a photo-electric chart frame sensor circuit 122, a microprocessor 123, and a user/operator input circuit 124.

The microprocessor 123 interprets signals from the chart sensor circuit and user input circuitry using its internal programming to generate commands, including the PWM motor control signals for directing the immediate motor control circuitry 121 to move the motors. The microprocessor can be implemented using PIC or other commonly available computer. Here, the computer is a small 4 Kbyte programmable device having a 4 MHz exterior crystal oscillator and has interior bypass capacitors. It is programmed via a developmental system linked to a standard personal computer. Therefore, it is reprogrammable to fit the needs of a particular application with respect to display time parameters including variable time display, variable time of day or week display, or even units that can respond to a pager signal. The program inside the microprocessor contains all the control logic, command structure and PWM algorithms.

The immediate motor control circuitry 121 simply applies the proper drive voltage waveforms to the motors 12,13 according to the command signals arriving from the microprocessor 123. The circuitry also provides for dynamic braking of the motors to lessen motion due to inertia. The preferred approach involves implementing the immediate motor control circuitry with a solid state motor control chip, such as an Allegro motor control chip, for each motor and overload protection. These chips can receive and implement PWM motor control signals and other commands directly from the microprocessor. Solid state control is preferred due to its smaller size and the fact that relays generally make and break circuits under load, thereby burning contacts and lessening reliability with time.

User/operator input controls 124 are in the form of manual switches and dials or even a pager receiver. These devices signal the chart frame sensor circuit and the microprocessor, which still handles direct, powered control of the motors. Included among the controls is an auto/manual switch which allows the operator to control the apparatus from other controls on the front control panel (34 in FIG. 4) in order to load/change banners or just set the machine in a static mode, if desired.

An up/down, three position rocker switch allows for manual powered winding of the chart in either direction.

A multi-position is provided for the variable selection of banner display times. A Binary-Coded Decimal (BCD) or Octal rotary switch which directly interfaces with the microprocessor is preferred. Each position corresponds to a different display time ranging in the basic configuration from two seconds to one hour. The selectable display times are determined by algorithms in the computer program, and thus can also be altered by reprogramming.

One or more LED indicators may be provided to reflect the status of the switches and power availability.

The chart frame sensor circuit 122 comprises an electronic eye for sensing the passage of indicia located along the edge of the scrolling chart. The electronic eye contains an infra-red (IR) photo emitter and IR photo transistor arranged in a pulsed AC coupled detector scheme to reduce susceptibility to false signals. The microprocessor controls the eye repetition and the filtering and detection algorithms. Preferably, the emitter is pulsed from 2 to 20 KHz allowing for a very closely coupled scheme, capable of working in direct sunlight, near flash bulbs, or other high energy IR light sources.

Sensitivity of the eye circuit is controlled via a potentiometer on the user/operator input panel. This manually adjusts the current sent through the emitter and thus the strength of the output signal.

One advantage of this approach is that either a transmissive or reflective eye may be used in the sensor circuit depending on the application. Neither the circuitry nor the programming needs to be changed to accommodate either reflective or transmissive eye devices.

The power supply circuitry 120 provides a first operational voltage 130 used to power the integrated circuit based microprocessor 123 and immediate motor control 121. A second line 131 supplies the motor operational voltage to the motors through the immediate motor control circuitry. A third line 132 provides the proper voltage for the operation of the chart frame optical sensor circuit.

In the preferred embodiment, the power supply comprises the plug-in transformer which provides 12 volts A.C. to a rectifier circuit which converts it to the motor operational voltage of 17.5 volts D.C. The power supply further comprises 12 volt and 5 volt regulators, such as 7812 and 7805 TO-220 configuration devices, which are linear integrated circuits containing built-in current protection circuitry. These regulators are configured into a filtered, anti-droop circuit for providing stable power to the chart sensor circuit, and the microprocessor and immediate motor control chips.

An alternate embodiments of the apparatus can be powered by an internal set of batteries. In order to reduce the power requirement, the backlights can be eliminated. Instead, the back of the enclosure is left open or made of transparent or translucent material. The electrical control can be limited to a double-pole/double-throw rocker switch, thus eliminating the timing and mark-detecting circuitry.

The preferred chart frame detection scheme will be described in detail. In general, indicia or marks are placed along an edge of the carrier web to indicate the position of the frame within the viewing window and to inform the display controller whether to skip a frame or to wind in the opposite direction. One embodiment, as shown in FIGS. 13–16, provides a user manipulable indicator 140 so that the display of individual frames can be controlled.

Figures 12, 13, 14:
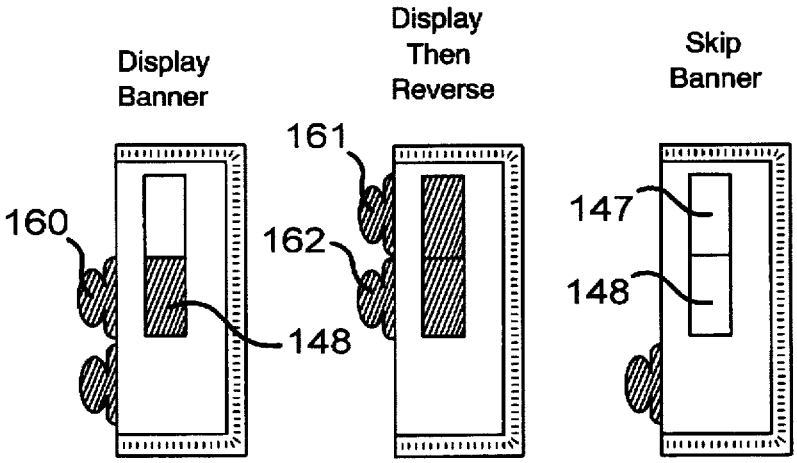
FIG. 12 is a diagrammatic front view of the chart frame indicator arranged in the "display banner then continue" configuration.
FIG. 13 is a diagrammatic front view of the chart frame indicator arranged in the "display banner then reverse" configuration.
FIG. 14 is a diagrammatic front view of the chart frame indicator arranged in the "skip banner" configuration.
Figure 11:
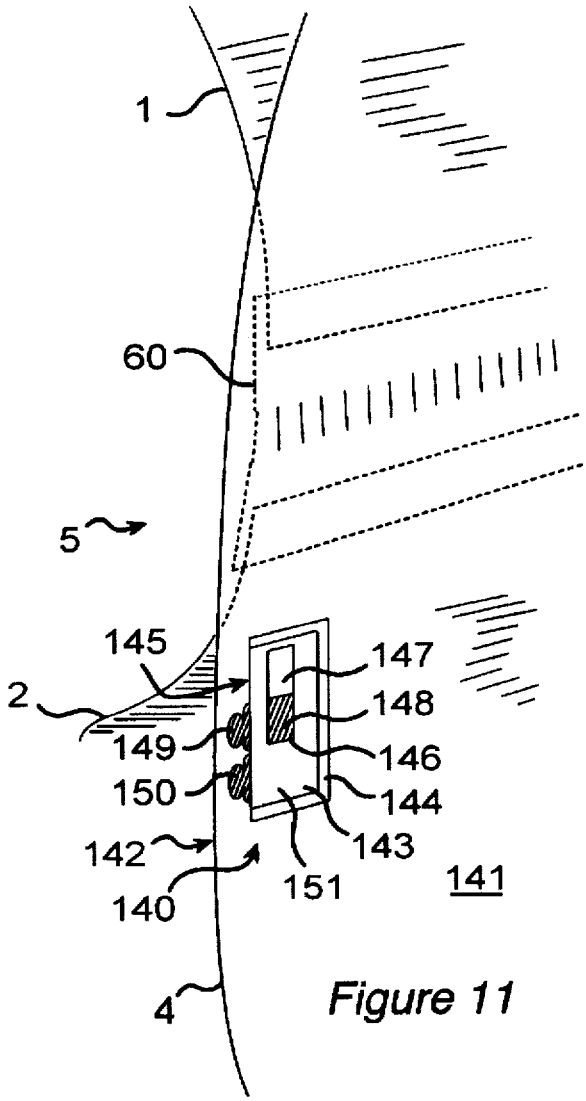
FIG. 11 is a partial perspective view of a scrolling chart having a chart frame indicator according to the invention.

FIG. 13 shows a rear view of an edge section of the scrolling chart 5. Shown is the rear surface 141 of the carrier web 4 at a point between chart frames where two banners 1,2 are attached to a resilient strip 60. A user manipulable chart frame indicator 140 is positioned on a portion of the web 4 proximate to the edge 142 so that it may be scanned by the optical sensor described earlier.

The indicator comprises a small generally rectangular sheet 143 of pliable material such as mylar. The sheet is attached to the web along three of its edges 144, thereby forming a pocket 145 between the web and sheet. An oblong window 146 is cut through the sheet exposing first and second adjacent indicator positions 147,148 or sub-windows.

Sheet-like indicator tabs 149,150 may be inserted into the pocket at points corresponding to the first and second indicator positions. A third position 151 can be provided to store unused tabs. In this embodiment, a reflective sensor is used. Therefore, the tabs have a reflective outer surface, whereas the rear surface of the carrier web and the outer surface of the sheet are relatively non-reflective. The insertion of tabs in one or both of the indictor positions informs the display control how to display this particular frame position.

Therefore, the placement of a tab into a sub-window alters an optical characteristic of the sub-window which can be read by the optical sensor. In this case the altered characteristic is reflectivity. In a transmissive scheme, the altered characteristic would be the transparency of the sub-window.

FIG. 14 shows a reflective tab 160 inserted in the first indicator position 148. This informs the display control that the current frame is in position to be displayed, and that winding is to continue in the same direction after display is complete.

FIG. 15 shows that two reflective tabs 161,162 are inserted into both the first and second indicator positions. This informs the display control that the current frame is in position to be displayed, and that the winding direction should be reversed after display is complete. This typically occurs at the frames at each end of the scrolling chart.

FIG. 16 shows that no reflective tabs have been inserted into either the first or second indicator positions 147,148. This informs the display control that the current frame is to be skipped, and that winding is to continue in the same direction.

This system of indicators can be implemented in other ways such as using apertures and transmissive sensors. In this way, pieces of duct-tape may simply be used to block the aperture. If the web is highly reflective the tabs can be non-reflective.

Alternatively, the indicator may be modified to contain even more information providing individual frame control, such as custom viewing times. For example, the optical sensor can be a bar code reader. A bar code may be printed on an adhesive tape label which is placed when the banner is installed. If the frame is to be skipped, the label is removed.

The structural, mechanical and electrical simplicity of the preferred apparatus allows for the manufacture of reliable, yet inexpensive displays ranging in heights from approximately 20 cm (8 inches) to 230 cm (90 inches) suitable for displaying a variety of charts made of paper, fabric, mylar or other synthetic materials.

A scroll of fifty 20 cm×25 cm (8×10 inches) frames on 25 micron (1 mil) thick printable plastic material results in a 3 cm (1.2 inch) diameter roll.

Many other features disclosed in Simson, U.S. Pat. No. 5,493,802, such as grounded, electrically conductive chart guides and anti-static strips mounted to the chart, may be incorporated in the current invention as needed.

While the preferred embodiment describes horizontal rollers and a chart scrolling vertically, the invention applies equally to other orientations.

While the preferred embodiment details an apparatus for displaying window-size banners which a single person would no trouble manipulating, the invention applies equally to larger billboard-sized banners or smaller toy-sized banners. One skilled in the art could easily modify the components to accommodate banners and charts of such dimensions.

While the preferred embodiments of the invention have been described, modifications can be made and other embodiments may be devised without departing from the spirit of the invention and the scope of the appended claims.

What is claimed is:

1. A display apparatus which comprises:

a scroll having a leading end and a trailing end;

a first roller having said leading end wound thereupon;

a second roller having said trailing end wound thereupon;

means for rotatively and detachably mounting said first and second rollers;

means for holding said first and second rollers in a substantially parallel and spaced-apart position in relation to each other;

a first and second motor;

means for operating said motors in concert;

said means for holding comprises:

an opposable pair of support members; and means for securing said support members to an enclosure in a substantially parallel, spaced apart and opposing orientation; and wherein a first one of said pair of support members comprises:

said first and second motors being attached thereon;

first means for driving said first roller with said first motor; and, second means for driving said second roller with said second motor;

wherein said means for operating comprise electrical circuit means for powering said motors;

wherein said circuit means comprises:

means for generating a pulse width modulated motor drive signal.

2. In a banner display apparatus having a scrollable chart comprising a plurality of banner holding frames, an improvement comprising:

means for controlling the display of a banner associated with a first one of said frames;

a scroll having a leading end and a trailing end;

a first roller having said leading end wound thereupon;

a second roller having said trailing end wound thereupon;

means for rotatively and detachably mounting said first and second rollers;

means for holding said first and second rollers in a substantially parallel and spaced-apart position in relation to each other;

a first motor and means for driving said first roller with said first motor;

a second motor and means for driving said second roller with said second motor; and means for controlling the relative speeds of said rollers to keep a displayed portion of said scroll consistently taut between said rollers;

wherein said means for controlling comprise:

means for powering said second motor;

means for rotating said second roller, via said scroll, at a speed faster than that provided by said means for powering said second motor;

means for generating a first motor drive signal having a first duty cycle; and, means for generating a pulse width modulated second motor drive signal having a second duty cycle of less duration than said first duty cycle.

3. The apparatus of claim 2, wherein said means for generating a first motor drive signal and said means for generating a second motor drive signal comprise a programmed microprocessor.

4. A scroll display device which comprises:

a scroll made of pliable, sheet material having opposite ends wound upon a pair of parallely spaced apart, rotatively mounted rollers;

motor means for alternately winding and unwinding said scroll between said rollers, thereby successively displaying sections of said scroll; and electrical circuit means for powering said motor means, wherein said circuit means comprise:

means for generating a pulse width modulated motor drive signal.

5. The device of claim 4, wherein said means for generating a pulse width modulated motor drive signal comprise:

means for generating a first motor drive signal having a first duty cycle; and, means for generating a pulse width modulated second motor drive signal having a second duty cycle of less duration than said first duty cycle.

6. The device of claim 4, wherein said means for generating a pulse width modulated motor drive signal comprise a programmed microprocessor.

7. The device of claim 4, wherein said motor means comprise:

a first motor operatively associated with a first one of said rollers; and a second motor operatively associated with a second one of said rollers.

8. The device of claim 7, wherein said circuit means for powering further comprise means for powering said second motor while said second one of said rollers is unwinding.

9. The device of claim 8, wherein said circuit means for powering further comprises:

means for rotating said second one of said rollers, via said scroll, at a speed faster than that provided by said means for powering said second motor.

* * * * *